US005328588A

United States Patent [19]

Hopkins

[11] Patent Number: 5,328,588

[45] Date of Patent: Jul. 12, 1994

[54] METHOD OF INLAYING METALS IN NON-CONDUCTIVE MATERIALS

[76] Inventor: Samuel Hopkins, P.O. Box 644, Carolina, R.I. 02812

[21] Appl. No.: 34,478

[22] Filed: Mar. 19, 1993

[51] Int. Cl.[5] ..... C25D 5/02

[52] U.S. Cl. ..... 205/120; 205/159; 205/222

[58] Field of Search ..... 205/120, 159, 222

[56] References Cited

U.S. PATENT DOCUMENTS

| | | | |
|---|---|---|---|
| 472,230 | 4/1892 | Scharling | 205/120 |
| 1,037,887 | 9/1912 | Franklin | 205/162 |
| 2,847,370 | 8/1958 | Howard | 205/120 |

*Primary Examiner*—Kathryn Gorgos
*Assistant Examiner*—William T. Leader
*Attorney, Agent, or Firm*—Salter, Michaelson & Benson

[57] ABSTRACT

A method of inlaying metal in non-conductive materials utilizes conventional electroforming or electroplating techniques to build up metal in grooves or channels formed in the surface of the material. An adhesive is deposited in the grooves, and a cathode is positioned in the adhesive. A metallic base is applied onto or into the adhesive in electrical communication with the cathode, and then the material is immersed in an electrolytic solution wherein metal is built up in the grooves by electrolysis using the metallic base as a cathode.

15 Claims, 2 Drawing Sheets

METHOD OF INLAYING METALS IN NON-CONDUCTIVE MATERIALS

BACKGROUND OF THE INVENTION

The instant invention relates to the jewelry art and more particularly to a method of inlaying metal in electrically non-conductive materials, such as ornamental stones.

The present method of inlaying metal in ornamental stones comprises forming narrow grooves in the stone, undercutting the grooves, i.e. making the base of the groove wider than the opening in the surface, and then mechanically forcing metal wire into the grooves using pressure so that the metal spreads into the groove and is held in place by the undercut. Any exposed metal above the top of the groove is then ground and polished so that the metal is flush with the surface of the stone. One disadvantage of the present method is that the pressure of inlaying the metal wire often cracks or shatters the stone and therefore the method requires the use of high-quality, or synthetic stones. Such high quality stones are expensive and increase the cost of the resulting article. Another disadvantage is that the method requires the time and skill of an experienced craftsman which further increases the cost of such jewelry articles. Also, since this technique utilizes wire as the inlay material, the inlay is necessarily limited to relatively narrow lines.

It is also known in the art to form a metal blank and then glue or rivet the blank into a complementary groove or recessed area formed in a stone. Although this inlay method works, the metal blanks do not always fit tightly within the recessed area and leave gaps between the metal and stone, thus detracting from the aesthetic value of the final product. Foils have also been fixed in grooved areas, however the foil lies below the surface of the stone and detracts from the appearance thereof.

Heretofore, methods have been known for depositing a thin metal film on the surface of a non-conductive material. In this regard, the U.S. Pat. Nos. to Scharling No. 472,230 and Franklin No. 1,037,887 represent the closest prior art to the present invention of which the applicant is aware. The Scharling patent discloses a method of depositing metals onto a glass or other non-conductive surface. The method comprises applying an adhesive substance to the surface, coating the adhesive with a metallic powder, and then electroforming a thin coating of metal onto the powder. The patent to Franklin discloses a similar process of plating metals onto non-conducting surfaces. This particular method comprises applying a sticky varnish material to the surface of the article, coating the varnish with a powdered graphite, and then electroplating the metal onto the surface, using the graphite as a cathode in the plating bath. However, none of these methods relate to an inlay process.

SUMMARY OF THE INVENTION

The instant invention provides a method of inlaying metals into non-conductive materials, such as ornamental stones, using conventional electroforming or electroplating techniques.

Briefly, the method comprises the steps of forming a grooved or recessed area defining the desired ornamental design in a surface of an ornamental stone or other non-conductive material, applying a layer of adhesive throughout the grooved area, depositing a metallic base onto the adhesive throughout the grooved area, and then providing a cathode that makes electrical contact with the metallic base. The stone is then immersed in an electrolytic solution whereupon metal builds up by electrolysis in the grooved area so as to completely fill the same. The metal which is built up in the grooves is then ground and polished so that the metal is flush with the surface of the stone.

Accordingly, it is an object of the instant invention to provide a method of inlaying metals into non-conductive materials using conventional electroforming or electroplating techniques.

It is another object to provide an inexpensive method of inlaying metals into ornamental stones.

It is yet another object to provide a method of forming a jewelry article comprising an ornamental stone having a decorative metallic inlay.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
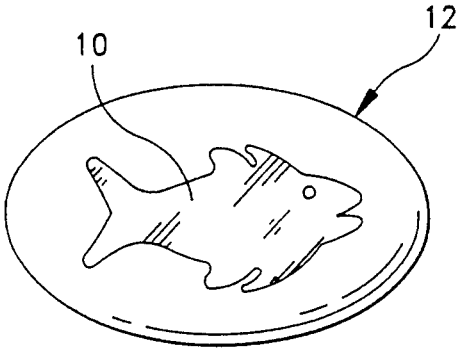
FIG. 1 is a plan view of an ornamental stone having a metal inlay formed therein according to the method of the instant invention.
Figure 2:
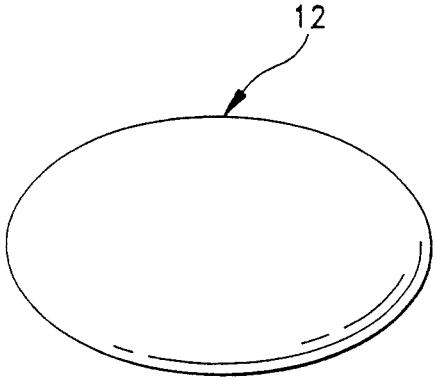
FIG. 2 is a plan view of an ornamental stone prior to the inlay process of the instant invention.

Referring now to the drawings, the metal inlay method of the instant invention is illustrated in FIGS. 1 through 13. As will hereinafter be more fully described, the instant method is particularly effective for inlaying a decorative metal design 10 into an ornamental stone 12 (FIG. 1) or other electrically non-conductive material. The instant method comprises the steps of forming a grooved or recessed area 14 in the stone 12, applying an adhesive 16 throughout the entire grooved area 14, applying a metallic base generally indicated at 20 onto and/or into the adhesive 16, positioning a cathode generally indicated at 18 in electrical contact with the metallic base, and immersing the stone 12 in an electrolytic solution.

Figure 3:
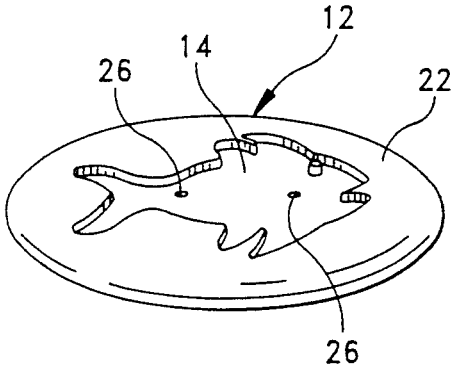
FIG. 3 is a perspective view of the ornamental stone with a grooved area formed therein.

The stone 12 preferably comprises a silica based ornamental stone, although other precious and semi-precious stones may also be utilized. The stone preferably has an upper decorative surface 22 which may be spherical or flat, and a lower base surface 24. The grooved area 14 is formed in the upper surface 22 of the stone 12, and it can be formed using conventional etching or grooving techniques known in the jewelry art, such as acid etching, or mechanical grooving using diamond burrs. The grooved area 14 is preferably formed in the shape of a decorative design, such as a fish design, as illustrated in FIGS. 1 and 3, and the sides of groove area 14 may have a generally concave shape, although this is not essential. It is pointed out that the grooved area 14 may be undercut 14*a* (FIG. 11) if desired, although this is not essential if a strong adhesive is utilized. In the preferred method, one or more apertures or holes 26 are formed in the grooved area 14 by drilling. The holes 26 extend through the stone 12 from the bottom of the grooved area 14 to the base surface 24, and provide a means of inserting the cathode 18 through the stone 12, where it is desired to have the cathode extend through the bottom of the stone.

The adhesive 16 preferably comprises an epoxy resin, although other types of adhesive are also suitable. The adhesive 16 is applied throughout the entire grooved area 14.

Figure 4:
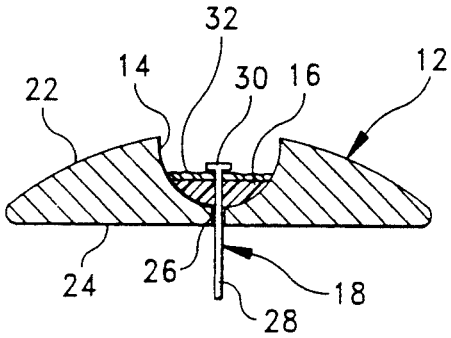
FIG. 4 is a cross sectional view of the stone showing a layer of adhesive in the groove with a metallic base thereon, and a cathode member extending upwardly from beneath the stone into contact with the metallic base.
Figure 5:
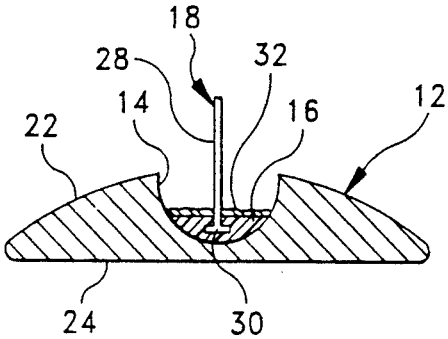
FIG. 5 is a view similar to FIG. 4 except that the cathode member extends downwardly from above the stone.

The cathode 18 preferably includes a thin wire-like body portion 28 and an enlarged head portion 30 at one end thereof. In the preferred method, the body portion 28 of the cathode 18 is inserted downwardly into the adhesive 16 so that the body portion 28 extends through the aperture 26 in the stone 12 and the head portion 30 is positioned above the adhesive 16, as illustrated in FIG. 4. In the instant embodiment, two such cathodes 18 and two such apertures 26 are utilized to increase the current flow during electroplating in order to cause uniform build up of metal throughout the grooved area 14. Alternatively, the head portion 30 of the cathode 18 can be inserted downwardly into the adhesive 16 as illustrated in FIG. 5, although for reasons hereinafter stated, it is preferred to position the cathode as illustrated in FIG. 4.

Figure 6:
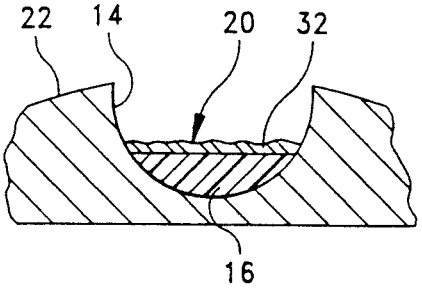
FIGS. 6–10 are enlarged fragmentary cross-sectional views showing different forms of the metallic base.
Figure 7:
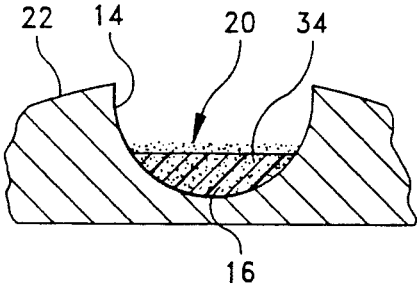
Figure 8:
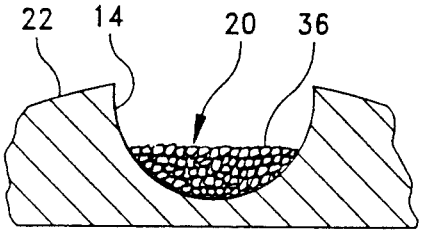
Figure 9:
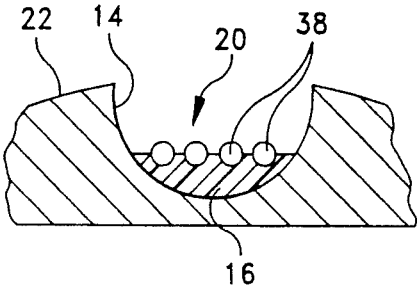
Figure 10:
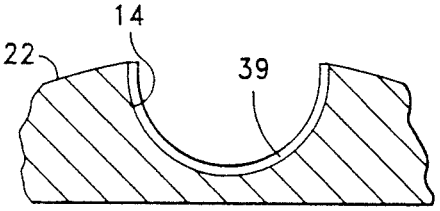
Figure 11:
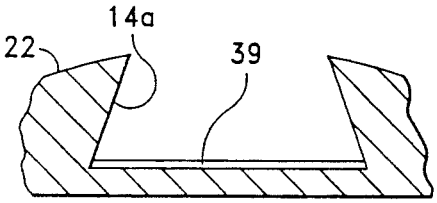
FIG. 11 is an enlarged fragmentary cross-sectional view showing an undercut in the grooved area and a metallic paint on the bottom of the grooved area.

The metallic base 20 is then applied onto the adhesive 16, as illustrated in FIG. 6, or alternatively, it could be applied prior to the inserting of cathodes 18. The metallic base 20 preferably comprises a thin metallic layer 32 which may consist of a metallic foil, a metallized tape, or a metal blank, which is applied onto the surface of the adhesive 16 so as to adhere thereto and cover the entire grooved area 14. The metal base 20 can alternatively comprise a metallic powder 34 which is imbedded in the adhesive 16 (FIG. 7), a plurality of metallic chips 36 imbedded in the adhesive 16 (FIG. 8), or a plurality of wires 38 imbedded in the adhesive 16 (FIG. 9). It is pointed out that the metallic base 20 must be in electrical communication with the cathode 18 in order for the electroplating process to properly proceed.

As an alternative to the use of an adhesive 16 and metallic base 20, the instant process may be carried out using a commercially available adhesive-conductive material, such as a conductive paint 39 (see FIG. 10) or spray, which will firmly adhere to the bottom of the grooved area 14. In this connection, an undercut 14*a* (FIG. 11) of the grooved area 14 is recommended when the adhesive strength of the paint 39 is not adequate to hold the inlay material within the grooved area 14.

Figure 12:
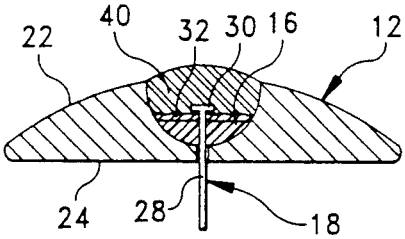
FIG. 12 is a cross sectional view similar to FIG. 4 showing the build up of metal by electrolysis in the grooved area.

Once the adhesive 16 is cured and hardened, the stone 12 is placed in an electrolytic solution having the desired metal dissolved therein and the cathode 18 or cathodes 18 are connected to an appropriate electrical connection wherein metal 40 is built up in the grooved area 14 through electrolysis (FIG. 12). The height of the electroplated metal 40 is left to the discretion of the craftsman, wherein the metal 40 can be recessed within the groove 14, or can be flush with the surface 22 of the stone 12, or can be raised above the surface 22 of the stone 12 as illustrated in FIG. 12. After the electroplating process is completed, the exposed body portion 28 of the cathode 18 is removed at the back surface 24 of the stone 12. If the metal 40 is raised above the stone surface 22 it may be left as is, or it may be ground and polished so that it is flush with the surface of the stone (FIG. 13).

Figure 13:
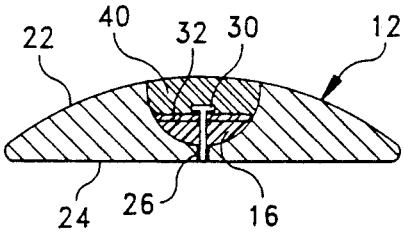
FIG. 13 shows the stone of FIG. 10 after the exposed portion of the cathode has been removed and the metal ground down so as to be flush with the surface of the stone.
Figure 14:
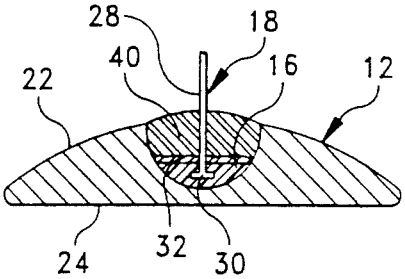
FIG. 14 is a cross-sectional view similar to FIG. 5 showing the build-up of metal by electrolysis in the grooved area.
Figure 15:
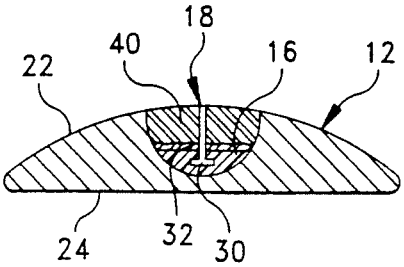
FIG. 15 shows the stone of FIG. 12 after the exposed portion of the cathode has been removed and the metal ground down so as to be flush with the surface of the stone.

The process illustrated in FIGS. 14 and 15 is the same as that first described for FIGS. 12 and 13 except that since the cathode wire 28 does not extend through the bottom of the stone in FIGS. 14 and 15, it is broken off at the top and then the grinding and polishing step results in both the metal 40 and the wire 28 being flush with the top surface of the stone. Although the orientation of the cathode as shown in FIGS. 5, 14 and 15 eliminates the step of having to provide the apertures 26, it has been found that the cathode is more securely gripped when it extends through the bottom of the stone, as per FIGS. 4, 12 and 13, and also the top of the cathode in the preferred form is completely covered by the metal 40, whereas in FIG. 15, the top edge of the wire 28 is exposed, although virtually invisible after the polishing operation has taken place.

Although the instant method as embodied herein is specifically described in connection with inlaying metallic designs in an ornamental stone 12, the method is equally effective for inlaying metals in other non-conductive materials. Such non-conductive materials would specifically include glass, wood, sea shells and any other non-conductive materials which are commonly utilized in the jewelry art, or other decorative arts.

It is seen therefore, that the instant invention provides an effective method of inlaying metal into non-conductive materials for decorative purposes with virtually no limitation on the shape or intricacy of the design being inlaid. The instant inlay method provides an inexpensive method for inlaying metal into ornamental stones which does not require the use of high grade ornamental stones or the skilled labor of an experienced craftsman. The instant method provides a means for producing professional quality, metal inlaid stones at a significant cost reduction, and thus will enable jewelers to utilize inlaid stones in less expensive costume jewelry, as well as fine jewelry. For these reasons, the metal inlay method of the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of inlaying metal into a non-conductive material comprising the steps of:

forming a recessed area in a surface of said non-conductive material;

depositing a layer of adhesive throughout said recessed area;

positioning a cathode in said adhesive;

depositing a metallic base in said adhesive throughout said recessed area, said metallic base electrically communicating with said cathode; and immersing said non-conductive article in an electrolytic solution wherein metal is built up in said recessed area by electrolysis.

2. In the method of claim 1, said metallic base comprising a metallic foil applied on said adhesive.

3. In the method of claim 1, said metallic base comprising a metallic powder imbedded in said adhesive.

4. In the method of claim 1, said metallic base comprising a plurality of metallic chips imbedded in said adhesive.

5. In the method of claim 1, said metallic base comprising a plurality of metallic wires imbedded in said adhesive.

6. In the method of claim 1, said metallic base comprising a metallized tape applied on said adhesive.

7. In the method of claim 1, said metallic base comprising a metal blank having a shape complementary to said recessed area, said metal blank being applied on said adhesive.

8. The method of claim 1 further comprising the step of forming an aperture in said recessed area which extends through said non-conductive material, said cathode extending through said aperture.

9. The method of claim 1 further comprising the step of grinding said metal so that said metal is flush with the surface of said non-conductive material.

10. In the method of claim 1, said non-conductive material comprising a silica based material.

11. In the method of claim 1, said non-conductive material comprising stone.

12. A method of inlaying metal into a decorative stone, said stone having opposite first and second surfaces, said method comprising the steps of:

forming a grooved area in the first surface of said stone;

depositing a layer of adhesive throughout said grooved area;

positioning a wire cathode in said adhesive;

depositing a metallic base on said adhesive throughout said grooved area, said metallic base electrically communicating with said wire cathode;

immersing said stone in an electrolytic solution wherein metal is built up in said grooved area by electrolysis.

13. The method of claim 12 further comprising the step of forming an aperture in said grooved area extending through said stone to said second surface, said wire cathode extending through said aperture and outwardly from said second surface.

14. The method of claim 12 further comprising the step of grinding said metal so that said metal is flush with the first surface of said stone.

15. A method of inlaying metal into a non-conductive material comprising the steps of:

forming a grooved area in a surface of said non-conductive material, said grooved area including an undercut around the peripheral edge thereof;

depositing an adhesive-conductive material throughout said grooved area;

positioning a cathode in said grooved area, said adhesive-conductive material electrically communicating with said cathode; and immersing said non-conductive article in an electrolytic solution wherein metal is built up in said grooved area by electrolysis.

* * * * *